US010626339B2

(12) United States Patent
Kokayeff et al.

(10) Patent No.: US 10,626,339 B2
(45) Date of Patent: Apr. 21, 2020

(54) PROCESS AND APPARATUS FOR RECYCLING CRACKED HYDROCARBONS

(71) Applicant: UOP LLC, Des Plaines, IL (US)

(72) Inventors: Peter Kokayeff, Naperville, IL (US); Robert L. Mehlberg, Wheaton, IL (US)

(73) Assignee: UOP LLC, Des Plaines, IL (US)

( * ) Notice: Subject to any disclaimer, the term of this patent is extended or adjusted under 35 U.S.C. 154(b) by 237 days.

(21) Appl. No.: 15/610,433

(22) Filed: May 31, 2017

(65) Prior Publication Data

US 2018/0079974 A1 Mar. 22, 2018

Related U.S. Application Data

(60) Provisional application No. 62/397,290, filed on Sep. 20, 2016.

(51) Int. Cl.
*C10G 69/04* (2006.01)

(52) U.S. Cl.
CPC ..... *C10G 69/04* (2013.01); *C10G 2300/107* (2013.01); *C10G 2300/1077* (2013.01); *C10G 2300/202* (2013.01)

(58) Field of Classification Search
CPC ..... C10G 69/04; C10G 2300/107; C10G 2300/202; C10G 2300/1077
See application file for complete search history.

(56) References Cited

U.S. PATENT DOCUMENTS

| | | | | |
|---|---|---|---|---|
| 4,585,545 | A | 4/1986 | Yancey et al. | |
| 5,152,883 | A | 10/1992 | Melin et al. | |
| 6,123,830 | A * | 9/2000 | Gupta | C10G 69/04 208/57 |
| 7,312,370 | B2 | 12/2007 | Pittman et al. | |
| 8,585,889 | B2 | 11/2013 | Kim et al. | |
| 2012/0241359 | A1 * | 9/2012 | Al-Thubaiti | B01J 8/26 208/61 |
| 2015/0274611 | A1 | 10/2015 | Zhu et al. | |
| 2015/0274613 | A1 | 10/2015 | Pham et al. | |

* cited by examiner

*Primary Examiner* — Randy Boyer
*Assistant Examiner* — Juan C Valencia
(74) *Attorney, Agent, or Firm* — Paschall & Associates, LLC; James C. Paschall

(57) ABSTRACT

Processes and apparatuses are disclosed for catalytically cracking hydrocarbons comprising hydrotreating a residual feed stream and a recycle cracked stream comprising an oil to provide a hydrotreated effluent stream. The hydrotreated effluent stream is separated to provide a FCC feed stream and a distillate stream. The FCC feed stream is fed to a first riser reactor to provide a first cracked stream. The distillate stream is fed to a second riser reactor to provide a second cracked stream. The first cracked stream and the second cracked stream are fed to a main fractionation column. The first cracked stream and the second cracked stream are fractionated in the main fractionation column. The recycle cracked stream is taken from the main fractionation column.

18 Claims, 1 Drawing Sheet

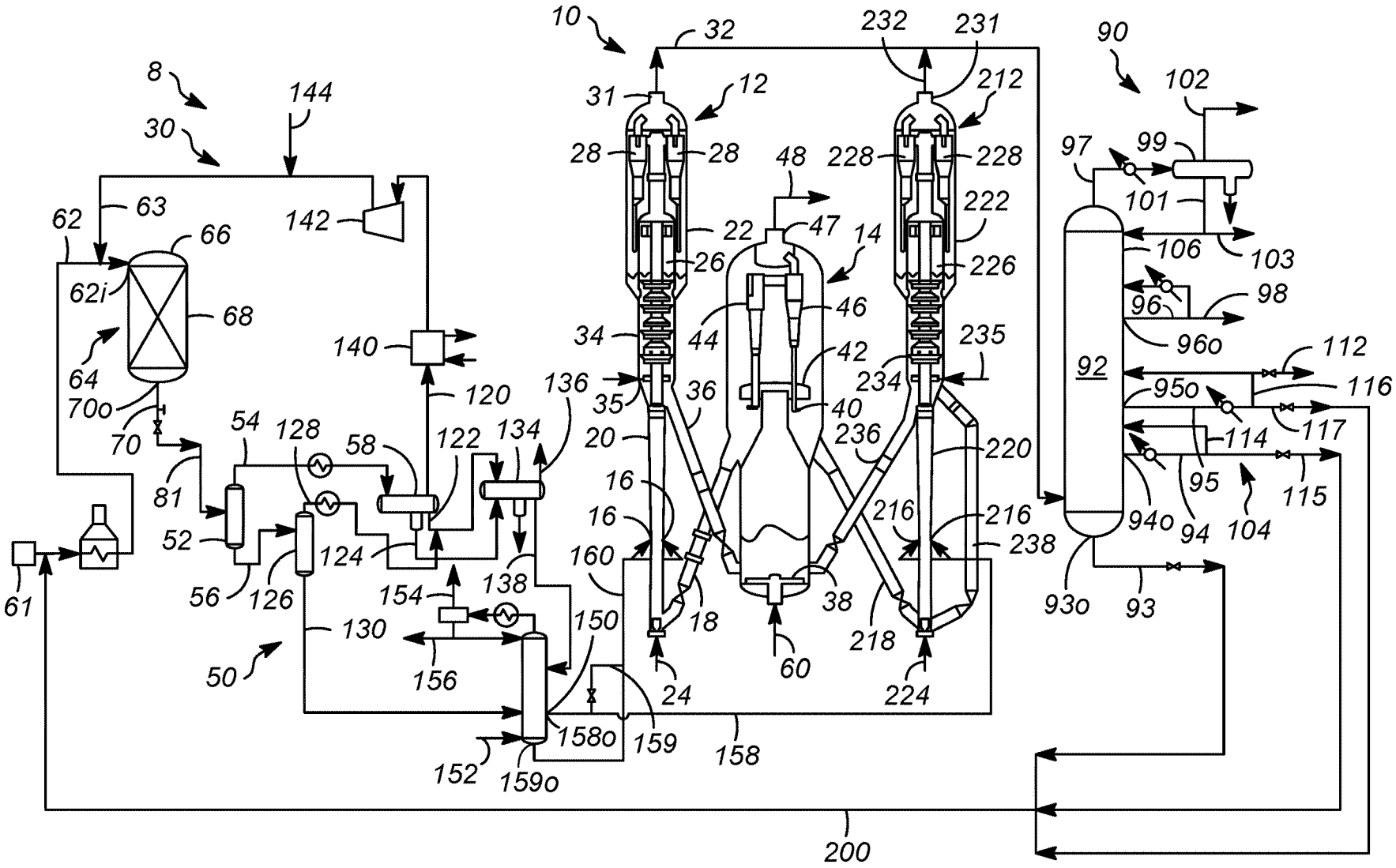
10
12
14
8
30
50
90
92
200

PROCESS AND APPARATUS FOR RECYCLING CRACKED HYDROCARBONS

CROSS-REFERENCE TO RELATED APPLICATION

This application claims priority from Provisional Application No. 62/397,290 filed Sep. 20, 2016, the contents of which cited application are hereby incorporated by reference in its entirety.

BACKGROUND OF THE INVENTION

The field of the invention is fluid catalytic cracking (FCC).

FCC technology, now more than 70 years old, has undergone continuous improvement and remains the predominant source of gasoline production in many refineries. This gasoline, as well as lighter products, is formed as the result of cracking heavier, less valuable hydrocarbon feed stocks such as gas oil.

In its most general form, the FCC process comprises a reactor that is closely coupled with a regenerator, followed by downstream hydrocarbon product separation. Hydrocarbon feed contacts catalyst in the reactor to crack the hydrocarbons down to smaller molecular weight products. During this process, coke tends to accumulate on the catalyst which is burned off in the regenerator.

When an atmospheric residue or a vacuum residue feed is to be cracked via FCC, with either propylene or gasoline as the desired product, light cycle oil (LCO), a less desireable product is also produced and can be directed to the diesel pool. LCO is a highly aromatic product boiling in the diesel range (300-700° F.). Due to its aromatic nature, LCO has a very low cetane number in the range of about 20 to about 25 and has limited applicability as a blendstock for diesel fuel without extensive hydrotreating. Additionally, it is resistant to cracking in the FCC process due to its aromatic nature. Accordingly, LCO may degrade the quality of the diesel pool due to its high aromaticity and low cetane value. Upgrading of LCO to petrochemicals would be desirable.

Heavy Cycle Oil (HCO) is also produced in the FCC unit with little use other than for fuel oil. Further conversion of the HCO to motor fuel products would also be desirable.

Also, clarified slurry oil, (CSO), a heavy oil is also produced as a byproduct of catalytic cracking. These are highly aromatic, high boiling, dense liquids and are the hydrocarbon fractions which remain as a bottoms fraction after catalytic cracking and are used primarily as heavy fuel oil. Further conversion of the CSO to motor fuel products would also be desirable.

SUMMARY OF THE INVENTION

An embodiment of the invention is a process for catalytically cracking hydrocarbons comprising hydrotreating a residual feed stream and a recycle cracked stream comprising an oil at hydrotreating reaction conditions in presence of hydrogen to provide a hydrotreated effluent stream. The hydrotreated effluent stream is separated to provide a FCC feed stream comprising heavy hydrocarbons and a distillate stream. The FCC feed stream is fed to a first riser reactor and contacted with a first catalyst to catalytically crack the FCC feed stream to provide a first cracked stream. The distillate stream is fed to a second riser reactor and contacted with a second catalyst to catalytically crack the distillate stream to provide a second cracked stream. The first cracked stream is fed to a main fractionation column. The first cracked stream is fractionated in the main fractionation column. The recycle cracked stream is taken stream from the main fractionation column.

Another embodiment of the invention is a process for process for catalytically cracking hydrocarbons comprising hydrotreating a residual feed stream and a recycle LCO stream at hydrotreating reaction conditions in presence of hydrogen to provide a hydrotreated effluent comprising hydrotreated LCO. The hydrotreated effluent is separated in a hydrotreating fractionation column. A FCC feed stream is taken through a bottoms outlet from a bottom of the hydrotreating fractionation column. A distillate stream is taken through a side outlet from a side of the hydrotreating fractionation column, the distillate steam comprising hydrotreated LCO. The FCC feed stream is fed to a first riser reactor and contacted with a first catalyst to catalytically crack the FCC feed stream to provide a first cracked stream. The distillate stream is fed to a second riser reactor and contacted with a second catalyst to catalytically crack the distillate stream to provide a second cracked stream. The first cracked stream is fed to a main fractionation column. The first cracked stream is fractionated in the main fractionation column. The recycle LCO stream is taken from the main fractionation column.

Another embodiment of the invention is an apparatus for catalytically cracking hydrocarbons comprising a hydrotreating reactor in downstream communication with a recycle cracked line comprising a recycle cracked stream and in communication with a residual feed line comprising a residual feed stream, to provide a hydrotreated effluent. A hydrotreating fractionation column is in communication with the hydrotreating reactor. A FCC feed line is in communication with the hydrotreating fractionation column, the FCC feed line comprising a FCC feed stream. A distillate line is in communication with the hydrotreating fractionation column, the distillate line comprising a distillate stream. A first riser reactor in downstream communication with the FCC feed line. A first cracked line is in communication with the first riser reactor, the first cracked line comprising a first cracked stream. A second riser reactor is in downstream communication with the distillate line. A second cracked line is in communication with the second riser reactor, the second cracked line comprising a second cracked stream. A main fractionation column is in downstream communication with the first cracked line. The recycle cracked line is in downstream communication with the main fractionation column, the recycle cracked line comprising the recycle cracked stream.

Advantageously, the process can enable minimizing the undesirable oil by-products such as LCO, HCO or slurry oil by converting it to the desired products such as propylene and gasoline.

Additional features and advantages of the invention will be apparent from the description of the invention, figure and claims provided herein.

BRIEF DESCRIPTION OF THE DRAWING

The FIGURE is a schematic drawing of a hydroprocessing unit and an FCC unit.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "bypass" means that the object is out of downstream communication with a bypassing subject at least to the extent of bypassing.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripping columns omit a reboiler at a bottom of the column and instead provide heating requirements and separation impetus from a fluidized inert media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T95" means the temperature at which 5 volume percent or 95 volume percent, as the case may be, respectively, of the sample boils using ASTM D-86.

As used herein, the term "initial boiling point" (IBP) means the temperature at which the sample begins to boil using ASTM D-86.

As used herein, the term "end point" (EP) means the temperature at which the sample has all boiled off using ASTM D-86.

As used herein, the term "diesel cut point" is between about 343° C. (650° F.) and about 399° C. (750° F.) using the TBP distillation method.

As used herein, the term "diesel boiling range" means hydrocarbons boiling in the range of between about 132° C. (270° F.) and the diesel cut point using the TBP distillation method.

As used herein, the term "diesel conversion" means conversion of feed that boils above the diesel cut point to material that boils at or below the diesel cut point in the diesel boiling range.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "predominant" or "predominate" means greater than 50%, suitably greater than 75% and preferably greater than 90%.

DETAILED DESCRIPTION

The FIGURE, wherein like numerals designate like components, illustrates an apparatus and process 8 that is equipped for processing a residual feed stream. The apparatus and process 8 generally include an FCC unit 10, a hydroprocessing unit 30, a hydroprocessing recovery section 50 and an FCC recovery section 90. The FCC unit 10 includes a first FCC reactor 12 including a first riser reactor 20, a second FCC reactor 212 including a second riser reactor 220 and a catalyst regenerator 14.

The residual feed stream may first be processed in the hydroprocessing unit 30. In one aspect, the process and apparatus described herein are particularly useful for hydrotreating a hydrocarbon feed stream comprising a residual feedstock. Atmospheric residue is a preferred feedstock boiling with an IBP of around or about 340° C. (644° F.), a T5 between about 340° C. (644° F.) and about 360° C. (680° F.) and a T95 of between about 700° C. (1292° F.) and about 900° C. (1652° F.) obtained from the bottoms of an atmospheric crude distillation column. Atmospheric residue is generally high in coke precursors and metal contamination. Vacuum residue is another preferred feedstock with an IBP above about 510° C. (950° F.). Other heavy hydrocarbon feedstocks which may be suitable as feedstocks include heavy bottoms from crude oil, heavy bitumen crude oil, shale oil, tar sand extract, deasphalted residue, products from coal liquefaction, vacuum reduced crudes. The residual feed stream may also include mixtures of the above hydrocarbons and the foregoing list is not comprehensive. In accordance with various embodiments, the residual feed stream comprises one of atmospheric residue and vacuum residue.

In the hydroprocessing unit 30, one hydroprocessing zone 64 is shown. However, more than one hydroprocessing zone are contemplated. The hydroprocessing zone 64 may be a hydroprocessing catalyst bed in a hydroprocessing reactor vessel or it may be a hydroprocessing reactor comprising one or more hydroprocessing catalyst beds. In the FIGURE, the hydroprocessing zone 64 includes a hydrotreating reactor 66 comprising a single bed 68 of hydrotreating catalyst. As illustrated, a residual feed stream in line 62 and a recycle cracked stream in line 200 comprising an oil are fed to the hydrotreating reactor 66. In accordance with an exemplary embodiment as shown in the FIGURE, the residual feed stream in line 62 and the recycled cracked stream in line 200 are combined prior to introduction to the hydrotreating reactor 66. In an aspect, the residual feed stream in line 62 and the recycled cracked stream in line 200 may be introduced directly to the hydrotreating reactor 66. At least one of a clarified slurry oil stream, a heavy cycle oil stream or a light cycle oil stream may be recycled via the recycle cracked stream in line 200 as discussed in detail later. In an exemplary embodiment, the recycle cracked stream may be a recycle light cycle oil stream in line 200. The residual feed stream in residual feed line 62 may be further mixed with hydrogen from hydrogen line 63 and the mixed residual feed stream may be fed to the hydrotreating reactor 66 through a first inlet **62*i*. The first inlet 62*i* is in downstream communication with a source of the residual feed stream such as a feed tank 61. Water may be added to the residual feed in line 62. The residual feed stream may be heated in a fired heater before entering the hydroprocessing zone 64. The recycle cracked stream in line 200 may be provided to the residual feed line 62 either upstream or downstream of the fired heater. A mixture of the residual feed stream and the recycle cracked stream is hydrotreated at hydrotreating reaction conditions over hydrotreating catalyst to provide a hydrotreated effluent stream in hydrotreated effluent line 70. In an exemplary embodiment, the recycle cracked stream may be the recycle LCO stream and the hydrotreated effluent stream in hydrotreated effluent line 70** comprises hydrotreated LCO.

Suitable hydroprocessing catalysts for use in the hydrotreating reactor 66 are any known conventional hydrotreating catalysts and include those which are comprised of at least one Group VIII metal, preferably iron, cobalt and nickel, more preferably nickel and/or cobalt and at least one Group VI metal, preferably molybdenum and tungsten, on a high surface area support material, preferably alumina. It is within the scope of the present invention that more than one type of hydrotreating catalyst be used in the same reaction vessel or catalyst bed. The Group VIII metal is typically present in an amount ranging from about 1 to about 10 wt %, preferably from about 2 to about 5 wt %. The Group VI metal will typically be present in an amount ranging from about 1 to about 20 wt %, preferably from about 2 to about 10 wt %. RCD-5 and RCD-8 are suitable catalysts for the first hydroprocessing zone 64 available from UOP LLC in Des Plaines, Ill. The hydroprocessing zone 64 is intended to demetallize the residual feed stream and the recycle cracked stream to produce the hydrotreated effluent stream in hydrotreated effluent line 70 exiting the hydroprocessing zone through a first outlet 70*o*. The metal content of the hydrotreated effluent stream may be less than about 200 wppm and preferably between about 5 and about 75 wppm. The hydroprocessing zone 64 may also desulfurize and denitrogenate and increase hydrogen content of the residual feed stream and the recycle cracked stream.

In an exemplary embodiment, having recycle LCO stream as the recycle cracked stream in line 200, the hydroprocessing zone 64 may be preferably intended to saturate aromatic rings to enable them to be cracked in the FCC unit 10 while preserving a single ring to produce single ring aromatic compounds and light olefins. If the recycle cracked stream in line 200 is a heavy cycle oil (HCO) stream, the hydroprocessing zone 64 may be preferably intended to saturate aromatic rings to enable them to be cracked in the FCC unit 10 to make high quality diesel and gasoline.

The hydrotreated effluent stream in hydrotreated effluent line 70 may be separated in a hydrotreating fractionation column 150 to provide a FCC feed stream comprising heavy hydrocarbons and a distillate stream. In accordance with an exemplary embodiment as shown in the FIGURE, the hydrotreated effluent stream in hydrotreated effluent line 70 may be transported to the hydroprocessing recovery section 50, in an aspect to a hot separator 52.

Suitable hydrotreating reaction conditions in the hydroprocessing zone 64 include a temperature from about 204° C. (400° F.) to about 399° C. (750° F.), suitably between about 360° C. (680° F.) to about 382° C. (720° F.) and preferably between about 366° C. (690° F.) to about 377° C. (710° F.), a pressure from about 10.3 MPa (gauge) (1500 psig) to about 20.7 MPa (gauge) (3000 psig) and preferably no more than 17.9 MPa (gauge) (2600 psig) and a liquid hourly space velocity of the hydrocarbon feed stream from about 0.1 $hr^{-1}$ to about 10 $hr^{-1}$ in the hydroprocessing zone.

The hydroprocessing recovery section 50 may be provided in downstream communication with the hydrotreated effluent line 70 to separate the hydrotreated effluent stream to provide the FCC feed stream comprising heavy hydrocarbons and the distillate stream comprising hydrotreated oil present in the recycle cracked stream. In an exemplary embodiment, when the recycled cracked stream is the recycle LCO stream, the hydroprocessing recovery section 50 may provide the FCC feed stream comprising heavy hydrocarbons and the distillate stream comprising hydrotreated LCO.

In an aspect, the hydrotreating effluent stream in hydrotreated effluent line 70 may enter the hot separator 52. The hot separator 52 separates the hydrotreating effluent stream to provide a vaporous hydrocarbonaceous hot separator overhead stream in an overhead line 54 and a liquid hydrocarbonaceous hot separator bottoms stream in a bottoms line 56. The hot separator 52 is in direct downstream communication with the hydroprocessing zone 64. The hot separator 52 operates at about 177° C. (350° F.) to about 371° C. (700° F.). The vaporous hydrocarbonaceous hot separator overhead stream in the overhead line 54 may be cooled before entering a cold separator 58. To prevent deposition of ammonium bisulfide or ammonium chloride salts in the line 54 transporting the hot separator overhead stream, a suitable amount of wash water (not shown) may be introduced into line 54.

The cold separator 58 serves to separate hydrogen from hydrocarbon in the hydrotreating effluent stream for recycle to the hydroprocessing zone 64 in line 63. The vaporous hydrocarbonaceous hot separator overhead stream may be separated in the cold separator 58 to provide a vaporous cold separator overhead stream comprising a hydrogen-rich gas stream in an overhead line 120 and a liquid cold separator bottoms stream in the bottoms line 122. The cold separator 58, therefore, is in downstream communication with the overhead line 54 of the hot separator 52. The cold separator 58 may have a boot for collecting an aqueous phase in line 124.

The liquid hydrocarbonaceous stream in the hot separator bottoms line 56 may be let down in pressure and flashed in a hot flash drum 126 to provide a hot flash overhead stream of light ends in an overhead line 128 and a heavy liquid stream in a hot flash bottoms line 130. The hot flash drum 126 may be operated at the same temperature as the hot separator 52 but at a lower pressure. The heavy liquid stream in bottoms line 130 may be further fractionated in the hydrotreating fractionation column 150.

In an aspect, the liquid hydroprocessing effluent stream in the cold separator bottoms line 122 may be let down in pressure and flashed in a cold flash drum 134. The cold flash drum may be in downstream communication with a bottoms line 122 of the cold separator 58. In a further aspect, the vaporous hot flash overhead stream in overhead line 128 may be cooled and also separated in the cold flash drum 134. The cold flash drum 52 may separate the cold separator liquid bottoms stream in line 122 and hot flash vaporous overhead stream in overhead line 128 to provide a cold flash overhead stream of light ends in overhead line 136 and a cold flash bottoms stream in a bottoms line 138. The cold flash bottoms stream in bottoms line 138 may be introduced to the hydrotreating fractionation column 150. In an aspect, the hydrotreating fractionation column 150 may be in downstream communication with the cold flash bottoms line 138 and the cold flash drum 134.

The cold flash drum 134 may be in downstream communication with the bottoms line 122 of the cold separator 58, the overhead line 128 of the hot flash drum 126. In an aspect, the hot flash overhead line 128 joins the cold separator bottoms line 122 which feeds the hot flash overhead stream and the cold separator bottoms stream together to the cold flash drum 134. The cold flash drum 134 may be operated at the same temperature as the cold separator 58 but typically at a lower pressure. The aqueous stream in line 124 from the boot of the cold separator may also be directed to the cold flash drum 134. A flashed aqueous stream is removed from a boot in the cold flash drum 134.

The vaporous cold separator overhead stream comprising hydrogen in the overhead line 120 is rich in hydrogen. The cold separator overhead stream in overhead line 120 may be passed through a scrubbing tower 140 to remove hydrogen sulfide and ammonia by use of an absorbent such as an amine absorbent. The scrubbed hydrogen-rich stream may be compressed in a recycle compressor 142 to provide a recycle hydrogen stream and supplemented with make-up hydrogen stream from line 144 to provide the hydrogen stream in hydrogen line 63.

The hydrotreating fractionation column 150 may be in downstream communication with the cold flash drum 134 and the hot flash drum 126 for separating portions of the hydrotreating effluent stream into product streams including a distillate stream and an FCC feed stream. The hydrotreating fractionation column 150 fractionates the cold flash bottoms stream 138 and the hot flash bottoms stream 130 by use of a stripping media such as steam from line 152. The cold flash bottoms stream 138 may enter the hydroprocessing fractionation column 150 at a higher elevation than the hot flash bottoms stream 130. The product streams produced by the hydrotreating fractionation column 150 may include an overhead LPG stream in overhead line 154, a naphtha stream in line 156, a distillate stream comprising saturated naphthenic rings carried in line 158 and an FCC stream in a FCC feed line 160 which may be fed to the first FCC riser reactor 20. Further, the distillate stream in line 158 may be fed to the second FCC riser reactor 220. In accordance with an exemplary embodiment as shown in the FIGURE, the FCC feed stream is taken from a bottoms outlet 160*o* in a bottom of the hydrotreating fractionation column 150 in line 160 and the distillate stream is taken from a side outlet 158*o* in a side of the hydrotreating fractionation column 150 in line 158. The overhead stream may be condensed and separated in a receiver with a portion of the condensed liquid being refluxed back to the hydrotreating fractionation column 150. The net naphtha stream in line 156 may require further processing such as in a naphtha splitter column before blending in the gasoline pool. The hydrotreating fractionation column 150 may be operated with a bottoms temperature between about 288° C. (550° F.) and about 370° C. (700° F.) and at an overhead pressure between about 30 kPa (gauge) (4 psig) to about 200 kPa (gauge) (29 psig).

The FCC feed stream in FCC feed line 160 may be fed to first riser reactor 20 to contact the FCC feed stream with a first catalyst to catalytically crack the FCC feed stream to provide a first cracked stream in a first cracked line 32. Further, the distillate stream in distillate line 158 may be fed to the second riser reactor 220 and contacted with a second catalyst to catalytically crack the distillate stream to provide a second cracked stream in a second cracked line 232. In accordance with an exemplary embodiment as shown in the FIGURE, an auxiliary distillate stream in line 159 may be taken from the distillate stream and fed to the first riser reactor 20 regulated by a valve on auxiliary distillate line 159, along with the FCC feed stream in line 160. In various embodiment, the auxiliary distillate stream in line 159 may vary between 0 to 100%, preferably between 10 to 70% and more preferably between 30 to 50% of the distillate stream obtained from the hydrotreating fractionation column 150. Accordingly, the remaining portion may be passed to the second FCC riser reactor 220. In accordance with various embodiments, an additional stream comprising catalytically cracked naphtha stream may also be fed to the second FCC riser reactor 220. In an aspect, the catalytically cracked naphtha stream may comprise butenes and may predominantly comprise butenes. In accordance with an exemplary embodiment, at least a portion of a light naphtha stream in line 103 from the main fractionation column 92 may be introduced as the additional stream to the second riser reactor 220.

The FIGURE shows a typical FCC unit 10 including the first FCC reactor 12, in which a portion of the hydrotreated effluent stream comprising the FCC feed stream in the FCC feed line 160 is fed to be contacted with a regenerated cracking catalyst. Specifically, in an embodiment, regenerated cracking catalyst entering from a first regenerated catalyst standpipe 18 is contacted with the FCC feed stream in the first riser reactor 20 of the first FCC reactor 12. Portions of the hydrotreating effluent stream may be fed to the riser through the same or different distributors 16. In the first riser reactor 20 of the first FCC reactor 12, the FCC feed stream comprising portions of the hydrotreating effluent stream are contacted with the first catalyst to catalytically crack the FCC feed stream to provide the first cracked stream in line 32.

Further, as illustrated, the FCC unit 10 includes the second FCC reactor 212, in which a portion of the hydrotreated effluent stream comprising the distillate stream in the distillate line 150 is fed to be contacted with a regenerated cracking catalyst. Specifically, in an embodiment, regenerated cracking catalyst entering from a second regenerated catalyst standpipe 218 and a spent catalyst entering from spent catalyst standpipe 238 is contacted with the distillate stream in the second riser reactor 220 of the second FCC reactor 212. Portions of the hydrotreating effluent stream may be fed to the riser through the same or different distributors 216. In the second riser reactor 220 of the second FCC reactor 212, the distillate stream comprising portions of the hydrotreating effluent stream are contacted with the second catalyst to catalytically crack the FCC feed stream to provide the second cracked stream in line 232.

The contacting of the FCC feed stream with the first catalyst may occur in the first riser reactor 20 of the first FCC reactor 12, extending upwardly to the bottom of a first reactor vessel 22. The contacting of feed and the first catalyst is fluidized by gas from a fluidizing line 24. Heat from the first catalyst vaporizes the FCC feed stream and is thereafter cracked to lighter molecular weight hydrocarbons in the presence of the first catalyst as both are transferred up the riser 20 into the reactor vessel 22. In the first FCC reactor 12, saturated naphthenic rings are cracked open and alkyl substituents are cracked from aromatic rings to provide olefinic, aliphatic hydrocarbons in addition to catalytic cracking of the FCC feed stream to conventional cracked products. The cracked stream of hydrocarbon products in the riser 20 is thereafter disengaged from the first catalyst using cyclonic separators which may include a rough cut separator 26 and one or two stages of cyclones 28 in the first reactor vessel 22. A first cracked stream of product gases exit the first reactor vessel 22 through a product outlet 31 in a first cracked line 32 for transport to a downstream FCC recovery section 90.

The first riser reactor 20 can operate at any suitable temperature, and typically operates at a temperature of about 500° to about 580° C. at the riser outlet. The pressure of the first riser is from about 69 to about 517 kPa (gauge) (10 to 75 psig) but typically less than about 275 kPa (gauge) (40 psig). The catalyst-to-oil ratio, based on the weight of catalyst and feed hydrocarbons entering the riser, may range up to 30:1 but is typically between about 4:1 and about 10:1.

Similarly, contacting of the distillate stream with the second catalyst may occur in the second riser reactor 220 of the second FCC reactor 212, extending upwardly to the bottom of a second reactor vessel 222. The contacting of feed and the second catalyst is fluidized by gas from a fluidizing line 224. Heat from the second catalyst vaporizes the distillate stream and is thereafter cracked to lighter molecular weight hydrocarbons in the presence of the second catalyst as both are transferred up the second riser reactor 220 into the second reactor vessel 222. In the second FCC reactor 212, saturated naphthenic rings are cracked open and alkyl substituents are cracked from aromatic rings to provide olefinic, aliphatic hydrocarbons in addition to catalytic cracking of the distillate stream to conventional cracked products. The cracked stream of hydrocarbon products in the riser 220 is thereafter disengaged from the second catalyst using cyclonic separators which may include a riser termination device, such as vortex separation system (VSS) 226 and one or two stages of cyclones 228 in the reactor vessel 222. A second cracked stream of product gases exit the reactor vessel 222 through a product outlet 231 in a second cracked line 232 for transport to the downstream FCC recovery section 90.

The second riser reactor 220 can operate in any suitable condition, such as a temperature of about 500° C. (932° F.) to about 705° C. (1292° F.), preferably a temperature of about 550° C. (1022° F.) to about 600° C. (1112° F.), and a pressure of about 140 to about 400 kPa, preferably a pressure of about 170 to about 250 kPa. The catalyst-to-oil ratio, based on the weight of catalyst and feed hydrocarbons entering the riser, may range up to 40:1, preferably, between about 5:1 and about 30:1 and more preferably between about 5:1 and about 20:1.

In various embodiments, the operating outlet temperature in the second riser reactor 220 will be higher than the operating outlet temperature in the first riser reactor 20. Further, the second riser reactor 220 may have a higher catalyst to oil (C/O) ratio than the first riser reactor 20. In an exemplary embodiment, in which LCO stream is the recycle oil recycled back in line 200 to the hydroprocessing unit 30, conversion of the LCO in the second riser reactor to gasoline and LPG will be very high because of the high temperatures and high C/O ratio employed. Gasoline cracked from LCO will be more aromatic than gasoline cracked from the residue thereby improving octane value and improving the feedstock for petrochemical production. The LCO helps to dilute the partial pressure of the olefins in the second riser reactor which reduces hydrogen-transfer reactions which can saturate olefins and reduce octane value.

As shown in FIGURE, the first FCC reactor 12 and the second FCC reactor 212 may employ a common catalyst regenerator 14. In the instant aspect, the first catalyst and the second catalyst are same. In an embodiment, the first FCC reactor 12 and the second FCC reactor may have separate catalyst regenerators. In such an aspect, the first catalyst and the second catalyst may be different or of same type.

The catalyst in the first and second FCC reactor can be a single catalyst or a mixture of different catalysts. Usually, the catalyst includes two catalysts, namely a first FCC catalyst, and a second FCC catalyst. Such a catalyst mixture is disclosed in, e.g., U.S. Pat. No. 7,312,370 B2. Generally, the first FCC catalyst may include any of the well-known catalysts that are used in the art of FCC. Preferably, the first FCC catalyst includes a large pore zeolite, such as a Y-type zeolite, an active alumina material, a binder material, including either silica or alumina, and an inert filler such as kaolin.

Typically, the zeolites appropriate for the first FCC catalyst have a large average pore size, usually with openings of greater than about 0.7 nm in effective diameter defined by greater than about 10, and typically about 12, member rings. Suitable large pore zeolite components may include synthetic zeolites such as X and Y zeolites, mordenite and faujasite. A portion of the first FCC catalyst, such as the zeolite portion, can have any suitable amount of a rare earth metal or rare earth metal oxide.

The second FCC catalyst may include a medium or smaller pore zeolite catalyst, such as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. These catalysts may have a crystalline zeolite content of about 10 to about 50 wt % or more, and a matrix material content of about 50 to about 90 wt %. Catalysts containing at least about 40 wt % crystalline zeolite material are typical, and those with greater crystalline zeolite content may be used. Generally, medium and smaller pore zeolites are characterized by having an effective pore opening diameter of less than or equal to about 0.7 nm and rings of about 10 or fewer members. Preferably, the second FCC catalyst component is an MFI zeolite having a silicon-to-aluminum ratio greater than about 15. In one exemplary embodiment, the silicon-to-aluminum ratio can be about 15 to about 35.

The total catalyst mixture in the first and the second FCC reactor may contain about 1 to about 25 wt % of the second FCC catalyst, including a medium to small pore crystalline zeolite, with greater than or equal to about 7 wt % of the second FCC catalyst being preferred. When the second FCC catalyst contains about 40 wt % crystalline zeolite with the balance being a binder material, an inert filler, such as kaolin, and optionally an active alumina component, the catalyst mixture may contain about 0.4 to about 10 wt % of the medium to small pore crystalline zeolite with a preferred content of at least about 2.8 wt %. The first FCC catalyst may comprise the balance of the catalyst composition. The high concentration of the medium or smaller pore zeolite as the second FCC catalyst of the catalyst mixture can improve selectivity to light olefins. In one exemplary embodiment, the second FCC catalyst can be a ZSM-5 zeolite and the catalyst mixture can include about 0.4 to about 10 wt % ZSM-5 zeolite excluding any other components, such as binder and/or filler. In exemplary embodiments, the second FCC reactor may have a greater concentration of the second FCC catalyst, comprising the medium and smaller pore zeolite catalyst, than the first FCC catalyst. In an aspect, the second FCC reactor have more than about 50 wt % ZSM-5 zeolite than in the first FCC reactor. In another aspect, the second FCC reactor may have from about 25 wt % up to 100 wt % ZMS-5 zeolite.

The outlet temperature of the cracked products leaving the risers 20 and 220 should be between about 521° C. (970° F.) and about 593° C. (1100° F.) if petrochemicals, such as light olefins and aromatics, are most desired in the FCC product, for example if LCO is the recycle cracked stream in recycle line 200. On the other hand, the outlet temperature of the cracked products leaving the risers 20 and 220 should be between about 472° C. (850° F.) and about 538° C. (1000°

F.) if diesel and gasoline are most desired in the FCC product, for example if HCO is the recycle cracked stream in recycle line 200.

Inevitable side reactions occur in the risers 20 and 220 leaving coke deposits on the catalyst that lower catalyst activity. The spent or coked catalyst requires regeneration for further use. Coked catalyst, after separation from the gaseous cracked product hydrocarbons, falls into a stripping section 34 and 234 in the first FCC reactor 12 and the second FCC reactor 12 respectively, where steam is injected through a nozzle 35 and 235 respectively and distributor to purge any residual hydrocarbon vapor. After the stripping operation, the coked catalyst is fed to the catalyst regenerator 14 through a first spent catalyst standpipe 36 and a second catalyst standpipe 236 from the first FCC reactor 12 and second FCC reactor 212 respectively. In accordance with an exemplary embodiment as shown in the FIGURE, in the second FCC reactor 212, a portion of the coked catalyst is passed to the second riser reactor 220 through the spent catalyst standpipe 238, without regeneration.

The FIGURE depicts a regenerator 14 known as a combustor. However, other types of regenerators are suitable. In the catalyst regenerator 14, a stream of oxygen-containing gas, such as air, is introduced through an air distributor 38 to contact the coked catalyst, burn coke deposited thereon, and provide regenerated catalyst and flue gas. A stream of air or other oxygen containing gas is fed into the regenerator 14 through line 60. Catalyst and air flow upwardly together along a combustor riser 40 located within the catalyst regenerator 14 and, after regeneration, are initially separated by discharge through a disengager 42. Finer separation of the regenerated catalyst and flue gas exiting the disengager 42 is achieved using first and second stage separator cyclones 44, 46, respectively, within the catalyst regenerator 14. Catalyst separated from flue gas dispenses through diplegs from cyclones 44, 46 while flue gas significantly lighter in catalyst sequentially exits cyclones 44, 46 and exit the regenerator vessel 14 through flue gas outlet 47 in line 48. Regenerated catalyst is recycled back to the first riser reactor 20 and the second riser reactor 220 through the first regenerated catalyst standpipe 18 and the second regenerated catalyst standpipe 218 respectively.

As a result of the coke burning, the flue gas vapors exiting at the top of the catalyst regenerator 14 in line 48 contain CO, $CO_2$ and $H_2O$, along with smaller amounts of other species. Catalyst regeneration temperature is between about 500° C. (932° F.) and about 900° C. (1652° F.). Both the cracking and regeneration occur at an absolute pressure below about 5 atmospheres.

In the FCC recovery section 90, the gaseous cracked stream in the first cracked line 32 and the second cracked line 232 are mixed and are subsequently fed to a lower section of an FCC main fractionation column 92. In accordance with an exemplary embodiment, the first cracked stream in line 32 and the second cracked stream in line 232 may be processed separately and may be passed to separate fractionation columns. The main fractionation column 92 is in downstream communication with the first riser reactor 20 and the first FCC reactor 12. Further, the main fractionation column in is downstream communication with the second riser reactor 220 and the second FCC reactor 212. Several fractions may be separated and taken from the main fractionation column 92 including a slurry oil stream from the bottoms in line 93, a heavy cycle oil stream in line 94, a light cycle oil stream in line 95 and an optional heavy naphtha stream in line 98. Gasoline and gaseous light hydrocarbons are removed in overhead line 97 from the main fractionation column 92 and condensed before entering a main column receiver 99. An aqueous stream is removed from a boot in the receiver 99. Moreover, a condensed unstabilized, light naphtha stream is removed in bottoms line 101, wherein a portion of the light naphtha stream is passed back to the main fractionation column 92 and another portion of the light naphtha stream is taken out in line 103 for further processing. Further, a gaseous light hydrocarbon stream is removed in overhead line 102. Both streams in lines 101 and 102 may enter a vapor recovery section downstream of the main fractionation column 92. Propylene may be recovered from the light hydrocarbon stream in line 102. A portion of the light naphtha stream in bottoms line 101 may be refluxed to the main fractionation column 92.

The light unstabilized naphtha fraction preferably has an initial boiling point (IBP) in the $C_5$ range; i.e., between about 0° C. (32° F.) and about 35° C. (95° F.), and an end point (EP) at a temperature greater than or equal to about 127° C. (260° F.). The optional heavy naphtha fraction has an IBP just above about 127° C. (260° F.) and an EP at a temperature above about 204° C. (400° F.), preferably between about 200° C. (392° F.) and about 238° C. (460° F.). The LCO stream may have a T5 in the range of about 200° C. (392° F.) to about 244° C. (471° F.) and a T95 in the range of about 354° C. (669° F.) to about 377° C. (710° F.). The HCO stream has an IBP overlapping the EP temperature of the LCO stream and an EP in a range of about 385° C. (725° F.) to about 427° C. (800° F.). The HCO stream may have a T5 in the range of about 250° C. (482° F.) to about 349° C. (660° F.) and a T95 in the range of about 382° C. (720° F.) to about 404° C. (760° F.). The slurry oil stream has an IBP overlapping the EP temperature of the HCO stream and includes everything boiling at a higher temperature including solid catalyst fines.

As illustrated, either of the slurry oil stream in line 93, the heavy cycle oil stream in line 94, the light cycle oil stream in line 95 may be recycled to the hydrotreating reactor 66 in the hydroprocessing zone 64, from the main fractionation column 92. The oil stream to be passed to the hydrotreating reactor can be selected and controlled by the presence of valves on one or more product lines corresponding to the slurry oil, heavy cycle oil and the light cycle oil stream. In accordance with an exemplary embodiment as discussed, a valve on the LCO line 117 may be open and the LCO stream in line 117 may be passed to the hydrotreating reactor 66 in the recycle cracked line 200 and processed as described above. In an aspect, a valve on the HCO line 115 may be open and the HCO stream in line 115 may be passed to hydrotreating reactor 66 in the recycle cracked line 200 and processed further. In another aspect, a valve on line 93 may be open and the slurry oil may be passed to the hydrotreating reactor in the recycle cracked line 200. In the embodiment, recycling slurry oil to the hydrotreating reactor 66, the slurry oil stream may pass through a filter (now shown) to remove catalyst fines to provide a clarified slurry oil stream. In an aspect, the slurry oil stream may pass through an electrostatic precipitator to remove catalyst fines to provide the clarified slurry oil stream which may be recycled to the hydroprocessing zone 64. In accordance with an exemplary embodiment, the recycle cracked stream may be taken from a side outlet **95*o* or a side outlet 94*o* in the side 106 of the main fractionation column 92. In an aspect, the recycle cracked stream may be taken from a bottoms outlet 93*o* in the bottom of the main fraction column 92**.

If it is desired to recycle HCO to the hydroprocessing zone 64, a HCO stream is taken as the recycle cracked stream from the side outlet **94*o* in line 94 regulated by a control valve on line 115. By recycling an HCO stream to the hydroprocessing zone 64 in lines 94, 115 and 200, the yield of diesel and gasoline may be increased in the FCC unit over a yield that would have been obtained without recycling the HCO stream. The diesel stream may be recovered in an LCO product line 112 at a flow rate regulated by a control valve thereon. Gasoline may be recovered from the light naphtha stream in line 101 and the heavy naphtha stream in line 98**.

If it is desired to recycle LCO to the hydroprocessing zone 64, a LCO stream is taken as the recycle cracked stream from the side outlet 95*o* in line 95 regulated by a control valve on line 117. By recycling an LCO stream to the hydroprocessing zone 64 in lines 95, 117 and 200, the yield of aromatics and propylene may be increased in the FCC unit over a yield that would have been obtained without recycling the LCO stream. Aromatics may be recovered from the heavy naphtha stream in line 98. Propylene may be recovered from the light hydrocarbon stream in line 102.

If it is desired to recycle slurry oil to the hydroprocessing zone 64, the recycled cracked stream may be taken from the bottoms outlet 93*o* in the bottom of the main fractionation column 92 from which a slurry oil stream is taken as the recycle cracked stream in line 200 regulated by a control valve on line 93.

Any or all of lines 94-96 may be cooled and pumped back to the main column 92 to cool the main column typically at a higher location. Specifically, a side stream may be taken from an outlet 96*o*, 95*o* or 94*o* in the side 106 of the main fractionation column 92. The side stream may be cooled and returned to the main fractionation column 92 to cool the main fractionation column 92. A heat exchanger may be in downstream communication with the side outlet 96*o*, 95*o* or 94*o*.

A heavy naphtha stream in line 96 may be returned to the main fractionation column 92 after cooling while a heavy naphtha product stream is taken in line 98.

In an aspect, the side stream may be the HCO stream in line 94 taken from the lowest, side outlet 94*o* in the side 106 of the main fractionation column. A portion of the HCO stream may be taken as the recycled cracked stream from line 94 through a control valve on line 115 to the recycle cracked line 200 to the hydroprocessing zone 64. In an aspect, at least 5 wt-%, suitably at least 50 wt-%, preferably at least 75 wt-% and up to all of the HCO in line 95 may be recycled to the hydroprocessing zone 64. A return portion of the cooled HCO stream in line 114 may be returned to the main fractionation column to cool the main fractionation column 92. In an aspect, the HCO side stream in line 94 may be cooled to provide a cooled HCO side stream before a recycle cracked stream is taken from it in line 115 to recycle cracked line 200, and the return portion of the cooled HCO side stream may be returned to the main fractionation column 92 in return line 114 as shown in the FIGURE. Alternatively, the HCO side stream may be cooled in the return line 114 after the recycle cracked stream is taken from it in line 115 to recycle cracked line 200 to keep the recycle cracked stream in recycle cracked line 200 at higher temperature and to reduce pump around cooler duty. A heat exchanger may be in downstream communication with the lowest, side outlet 94*o*.

In a further aspect, the side stream may be the LCO stream in line 95 taken from the second lowest, side outlet 95*o* in the side 106 of the main fractionation column 92. A portion of the LCO stream may be taken as the recycled cracked stream from line 95 through a control valve on line 117 to the recycle cracked line 200 to the hydroprocessing zone 64. In an aspect, at least 5 wt-%, suitably at least 50 wt-%, preferably at least 75 wt-% and up to all of the LCO in line 95 may be recycled to the hydroprocessing zone 64. An unrecycled portion of the cooled LCO stream in line 116 may be split between a return portion stream that is returned to the main fractionation column to cool the main fractionation column 92 and an LCO product stream in the LCO product line 112 through a control valve thereon. In an aspect, the LCO side stream may be cooled in line 95 to provide a cooled LCO side stream before a recycle cracked stream is taken from it in line 117 to the recycle cracked line 200 and the return portion of the cooled LCO side stream may be returned to the main fractionation column 92 in return line 116 as shown in the FIGURE. Alternatively, the LCO side stream may be cooled after the recycle cracked stream is taken from it in line 117 to the recycle cracked line 200 and before or after the LCO product stream in line 112 is taken from the LCO side stream in line 116 to keep the recycle cracked stream in recycle cracked line 200 at higher temperature and to reduce pump around cooler duty. For example, the cooling may occur in the return line 116 upstream or downstream of the inlet to the product line 112. A heat exchanger may be in downstream communication with the second lowest, side outlet 95*o*.

It is contemplated that the recycle line 200 may transport a recycle cracked stream comprising at least a portion of the LCO side stream from the second lowest, side outlet 95*o* and at least a portion of the HCO side stream from the lowest side outlet 94*o* to the hydroprocessing zone In an aspect, the recycle line 200 may transport a recycle cracked stream comprising at least a portion of the LCO side stream from the second lowest, side outlet 95*o*, at least a portion of the HCO side stream from the lowest side outlet 94*o* and at least a portion of the slurry oil stream from the bottoms outlet 93*o* in the bottom of the main fractionation column 92, to the hydroprocessing zone.

Specific Embodiments

While the following is described in conjunction with specific embodiments, it will be understood that this description is intended to illustrate and not limit the scope of the preceding description and the appended claims.

A first embodiment of the invention is a process for catalytically cracking hydrocarbons comprising hydrotreating a residual feed stream and a recycle cracked stream comprising an oil at hydrotreating reaction conditions in presence of hydrogen to provide a hydrotreated effluent stream; separating the hydrotreated effluent stream to provide a FCC feed stream comprising heavy hydrocarbons and a distillate stream; feeding the FCC feed stream to a first riser reactor and contacting the FCC feed stream with a first catalyst to catalytically crack the FCC feed stream to provide a first cracked stream; feeding the distillate stream to a second riser reactor and contacting the distillate stream with a second catalyst to catalytically crack the distillate stream to provide a second cracked stream; feeding the first cracked stream to a main fractionation column; fractionating the first cracked stream in the main fractionation column; and taking the recycle cracked stream from the main fractionation column. An embodiment of the invention is one, any or all of prior embodiments in this paragraph up through the first embodiment in this paragraph further comprising taking an auxiliary distillate stream from the distillate stream and feeding the auxiliary distillate stream to the first riser reactor. An embodiment of the invention is one, any or all of prior embodiments in this paragraph up through the first embodiment in this paragraph further comprising feeding the second cracked stream to a second fractionation column. An embodiment of the invention is one, any or all of prior embodiments in this paragraph up through the first embodiment in this paragraph further comprising the feeding the second cracked stream to the main fractionation column. An embodiment of the invention is one, any or all of prior embodiments in this paragraph up through the first embodiment in this paragraph, wherein the recycle cracked stream comprises one of a light cycle oil, a heavy cycle oil or a clarified slurry oil. An embodiment of the invention is one, any or all of prior embodiments in this paragraph up through the first embodiment in this paragraph, wherein the distillate stream is taken from a side outlet of the hydrotreating fractionation column and the FCC feed stream is taken from a bottoms outlet of the hydrotreating fractionation column. An embodiment of the invention is one, any or all of prior embodiments in this paragraph up through the first embodiment in this paragraph, wherein the recycle cracked stream is taken from a side outlet in a side of the main fractionation column. An embodiment of the invention is one, any or all of prior embodiments in this paragraph up through the first embodiment in this paragraph, wherein contacting the FCC feedstream with the first catalyst takes place at a first temperature and contacting the distillate feed stream with the second catalyst takes place at a second temperature greater than the first temperature. An embodiment of the invention is one, any or all of prior embodiments in this paragraph up through the first embodiment in this paragraph, wherein the residual feed comprises one of atmospheric residue and vacuum residue. An embodiment of the invention is one, any or all of prior embodiments in this paragraph up through the first embodiment in this paragraph, wherein the hydrotreating reaction conditions comprises a pressure from about 13.7 MPa (2000 psig) to about 17.2 MPa (2500 psig) and a temperature of about 371° C. (700° F.) to about 415° C. (780° F.).

A second embodiment of the invention is a process for catalytically cracking hydrocarbons comprising hydrotreating a residual feed stream and a recycle LCO stream at hydrotreating reaction conditions in presence of hydrogen to provide a hydrotreated effluent comprising hydrotreated LCO; separating the hydrotreated effluent in a hydrotreating fractionation column; taking a FCC feed stream from a bottoms outlet of the hydrotreating fractionation column; taking a distillate stream from a side outlet of the hydrotreating fractionation column, the distillate steam comprising hydrotreated LCO; feeding the FCC feed stream to a first riser reactor and contacting the FCC feed stream with a first catalyst to catalytically crack the FCC feed stream to provide a first cracked stream; feeding the distillate stream to a second riser reactor and contacting the distillate stream with a second catalyst to catalytically crack the distillate stream to provide a second cracked stream; feeding the first cracked stream to a main fractionation column; fractionating the first cracked stream in the main fractionation column; and taking the recycle LCO stream from the main fractionation column. An embodiment of the invention is one, any or all of prior embodiments in this paragraph up through the second embodiment in this paragraph further comprising taking an auxiliary distillate stream from the distillate stream and feeding the auxiliary distillate stream to the first riser reactor. An embodiment of the invention is one, any or all of prior embodiments in this paragraph up through the second embodiment in this paragraph further comprising the feeding the second cracked stream to the main fractionation column. An embodiment of the invention is one, any or all of prior embodiments in this paragraph up through the second embodiment in this paragraph further comprising feeding the second cracked stream to a second fractionation column. An embodiment of the invention is one, any or all of prior embodiments in this paragraph up through the second embodiment in this paragraph, wherein contacting the FCC feed stream with the first catalyst takes place at a first temperature and contacting the distillate feed stream with the second catalyst takes place at a second temperature greater than the first temperature. An embodiment of the invention is one, any or all of prior embodiments in this paragraph up through the second embodiment in this paragraph, wherein the residual feed comprises one of atmospheric residue and vacuum residue.

A third embodiment of the invention is an apparatus for catalytically cracking hydrocarbons comprising a hydrotreating reactor in downstream communication with a recycle cracked line comprising a recycle cracked stream and in communication with a residual feed line comprising a residual feed stream, to provide a hydrotreated effluent; a hydrotreating fractionation column in communication with the hydrotreating reactor; a FCC feed line in communication with the hydrotreating fractionation column, the FCC feed line comprising a FCC feed stream; a distillate line in communication with the hydrotreating fractionation column, the distillate line comprising a distillate stream; a first riser reactor in downstream communication with the FCC feed line; a first cracked line in communication with the first riser reactor, the first cracked line comprising a first cracked stream; a second riser reactor in downstream communication with the distillate line; a second cracked line in communication with the second riser reactor, the second cracked line comprising a second cracked stream; a main fractionation column in downstream communication with the first cracked line; and the recycle cracked line in downstream communication with the main fractionation column, the recycle cracked line comprising the recycle cracked stream. An embodiment of the invention is one, any or all of prior embodiments in this paragraph up through the third embodiment in this paragraph further comprising an auxiliary distillate line fluidly connected to the distillate line and the first riser reactor is in communication with the auxiliary distillate line. An embodiment of the invention is one, any or all of prior embodiments in this paragraph up through the third embodiment in this paragraph further comprising a second fractionation column in communication with the second cracked line. An embodiment of the invention is one, any or all of prior embodiments in this paragraph up through the third embodiment in this paragraph, wherein the main fractionation column is in communication with the second cracked line.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for catalytically cracking hydrocarbons comprising:

hydrotreating a residual feed stream and a recycle cracked stream comprising an oil at hydrotreating reaction conditions in presence of hydrogen to provide a hydrotreated effluent stream;

separating the hydrotreated effluent stream to provide a FCC feed stream comprising heavy hydrocarbons and a distillate stream;

feeding the FCC feed stream to a first riser reactor and contacting the FCC feed stream with a first catalyst to catalytically crack the FCC feed stream to provide a first cracked stream;

feeding the distillate stream to a second riser reactor and contacting the distillate stream with a second catalyst to catalytically crack the distillate stream to provide a second cracked stream;

feeding the first cracked stream to a main fractionation column;

fractionating the first cracked stream in the main fractionation column; and taking the recycle cracked stream from a side outlet in a side of the main fractionation column.

2. The process of claim 1 further comprising taking an auxiliary distillate stream from the distillate stream and feeding the auxiliary distillate stream to the first riser reactor.

3. The process of claim 1 further comprising feeding the second cracked stream to a second fractionation column.

4. The process of claim 1 further comprising the feeding the second cracked stream to the main fractionation column.

5. The process of claim 1, wherein the recycle cracked stream comprises one of a light cycle oil (LCO), a heavy cycle oil (HCO) or a clarified slurry oil (CSO).

6. The process of claim 1, wherein the distillate stream is taken from a side outlet of a hydrotreating fractionation column and the FCC feed stream is taken from a bottoms outlet of the hydrotreating fractionation column.

7. The process of claim 1, wherein contacting the FCC feedstream with the first catalyst takes place at a first temperature and contacting the distillate feed stream with the second catalyst takes place at a second temperature greater than the first temperature.

8. The process of claim 1, wherein the residual feed comprises one of atmospheric residue and vacuum residue.

9. The process of claim 1, wherein the hydrotreating reaction conditions comprises a pressure from about 13.7 MPa (2000 psig) to about 17.2 MPa (2500 psig) and a temperature of about 371° C. (700° F.) to about 415° C. (780° F.).

10. A process for catalytically cracking hydrocarbons comprising:

hydrotreating a residual feed stream and a recycle LCO stream at hydrotreating reaction conditions in presence of hydrogen to provide a hydrotreated effluent comprising hydrotreated LCO;

separating the hydrotreated effluent in a hydrotreating fractionation column;

taking a FCC feed stream from a bottoms outlet of the hydrotreating fractionation column;

taking a distillate stream from a side outlet of the hydrotreating fractionation column, the distillate steam comprising hydrotreated LCO;

feeding the FCC feed stream to a first riser reactor and contacting the FCC feed stream with a first catalyst to catalytically crack the FCC feed stream to provide a first cracked stream;

feeding the distillate stream to a second riser reactor and contacting the distillate stream with a second catalyst to catalytically crack the distillate stream to provide a second cracked stream;

feeding the second cracked stream to a second fractionation column;

feeding the first cracked stream to a main fractionation column;

fractionating the first cracked stream in the main fractionation column; and taking the recycle LCO stream from the main fractionation column.

11. The process of claim 10 further comprising taking an auxiliary distillate stream from the distillate stream and feeding the auxiliary distillate stream to the first riser reactor.

12. The process of claim 10 further comprising the feeding the second cracked stream to the main fractionation column.

13. The process of claim 10, wherein contacting the FCC feed stream with the first catalyst takes place at a first temperature and contacting the distillate feed stream with the second catalyst takes place at a second temperature greater than the first temperature.

14. The process of claim 10, wherein the residual feed comprises one of atmospheric residue and vacuum residue.

15. An apparatus for catalytically cracking hydrocarbons comprising:

a hydrotreating reactor in downstream communication with a recycle cracked line comprising a recycle cracked stream and in communication with a residual feed line comprising a residual feed stream, to provide a hydrotreated effluent;

a hydrotreating fractionation column in communication with the hydrotreating reactor;

a FCC feed line in communication with the hydrotreating fractionation column, the FCC feed line comprising a FCC feed stream;

a distillate line in communication with the hydrotreating fractionation column, the distillate line comprising a distillate stream;

a first riser reactor in downstream communication with the FCC feed line;

a first cracked line in communication with the first riser reactor, the first cracked line comprising a first cracked stream;

a second riser reactor in downstream communication with the distillate line;

a second cracked line in communication with the second riser reactor, the second cracked line comprising a second cracked stream;

a main fractionation column in downstream communication with the first cracked line;

the recycle cracked line in downstream communication with the main fractionation column, the recycle cracked line comprising the recycle cracked stream; and a third fractionation column in communication with the second cracked line.

16. The apparatus of claim 15 further comprising an auxiliary distillate line fluidly connected to the distillate line and the first riser reactor is in communication with the auxiliary distillate line.

17. The apparatus of claim 15, wherein the main fractionation column is in communication with the second cracked line.

18. The apparatus of claim 15, wherein the recycle cracked stream is taken from a side outlet in a side of the main fractionation column.

* * * * *